US008347941B2

(12) United States Patent
Ilinich et al.

(10) Patent No.: US 8,347,941 B2
(45) Date of Patent: Jan. 8, 2013

(54) VACUUM PROCESSING CHAMBER MANUFACTURED BY ALUMINUM CASTING

(75) Inventors: Eduard Ilinich, Jona (CH); Eugenio De Biasio, Zurich (CH); Damian Ehrensperger, Basel (CH)

(73) Assignee: Oerlikon Solar AG, Trubbach, Truebbach (CH)

( * ) Notice: Subject to any disclaimer, the term of this patent is extended or adjusted under 35 U.S.C. 154(b) by 100 days.

(21) Appl. No.: 12/939,275

(22) Filed: Nov. 4, 2010

(65) Prior Publication Data

US 2011/0209662 A1 Sep. 1, 2011

Related U.S. Application Data

(60) Provisional application No. 61/258,324, filed on Nov. 5, 2009.

(51) Int. Cl.
*B22D 23/00* (2006.01)

(52) U.S. Cl. ..... 164/76.1; 29/527.5

(58) Field of Classification Search ..... 164/76.1; 29/527.2, 527.5

See application file for complete search history.

(56) References Cited

U.S. PATENT DOCUMENTS 7,732,056 B2 * 6/2010 Bhatnagar et al. ..... 428/472.2
7,762,114 B2 * 7/2010 Abney et al. ..... 72/84

FOREIGN PATENT DOCUMENTS

CN 1516749 A 7/2004
JP 2007-260624 A 10/2007
WO 03/012162 A1 2/2003

OTHER PUBLICATIONS

Chinese Office action for 201010547871.7 date Aug. 20, 2012.

* cited by examiner

*Primary Examiner* — Kuang Lin
(74) *Attorney, Agent, or Firm* — Pearne & Gordon LLP

(57) ABSTRACT

The present invention provides a method for manufacturing a vacuum processing chamber comprising a volume which is defined by a wall and which can be evacuated, said wall being made of aluminum by casting, said wall comprising an outer face and an inner face, said inner face faces the volume, and a method for improving the inner face of the wall of a vacuum processing chamber, wherein the inner face of said wall is smoothened by grinding and is subsequently pearl-blasted or shot-blasted. Vacuum processing chambers obtained by said methods are provided too.

9 Claims, 2 Drawing Sheets

VACUUM PROCESSING CHAMBER MANUFACTURED BY ALUMINUM CASTING

TECHNICAL FIELD

The present invention relates to vacuum processing chambers and to the manufacturing of vacuum processing chambers, in particular to vacuum processing chambers for use in deposition technologies such as physical vapour deposition (PVD), chemical vapour deposition (CVD) or plasma-enhanced chemical vapour deposition (PECVD), and to the manufacturing of such vacuum processing chambers. More particularly, the present invention relates to the manufacturing of vacuum processing chamber made of aluminum by casting rather than by welding.

BACKGROUND ART

Chambers for processing subjects under vacuum are usually manufactured from stainless steel or aluminum in that individual plates of steel or plates of aluminum are welded. For welding individual plates, said plates are clamped into a device and welded either manually or by a robotic device.

It is difficult to weld the plates of steel or plates of aluminum on the inside of a chamber, in particular in case of large scale chambers as used for coating architectural glass or solar cells by vacuum processes, and/or in case of welding by a robotic device. Therefore, the plates of such vacuum processing chambers are often welded on their outside only. As the plates for manufacturing a vacuum processing chamber may have a thickness of several centimeters, depending on the size of the chamber, gaps remain between the individual plates on the inside of the chamber.

These gaps are virtual leaks and may cause an adverse performance of the vacuum processing chamber. Particularly the pumping-off characteristics of a chamber manufactured this way is bad, because processing additives such as cooling media or oil enter the gaps and affect fumigation characteristics. In addition, said additives may interfere with the deposition process and impair the quality of the substrate.

To avoid such disturbing gaps, vacuum process chambers are manufactured from stainless steel, because plates of stainless steel can be welded easier on the inside of a chamber to be manufactured than aluminum. However, a process module or a process chamber made of stainless steel may possess problems if corrosive media are used. In current coating processes as used in industrial manufacturing of solar cells or other semi conductor products, the process chambers are regularly cleaned in situ. For this purpose, very often cleaning gases are utilized which are activated in a remote plasma source (RPS) or—in case of PECVD facilities—by the parallel electrodes of the reactor. The radicals generated thereby etch off the reaction products of previous coating processes and are subsequently removed from the process chamber by the vacuum pumps that are fitted to the chamber after suitable treatment of the etching products. To save time, corrosive chloride compounds and fluoride compounds ($SF_6$, $NF_3$) are employed. Upon use of such cleaning gases, the resistance of modern, commercially available steels to corrosion is insufficient, such that corrosion phenomena may occur in long term.

For large scale vacuum processing chambers, reinforcing ribs have to be provided to the side walls of the chamber such that the thickness of the walls may be reduced, but stiffness of the walls remains sufficient. However, providing vacuum processing chambers with reinforcing ribs requires tremendous manufacturing efforts and increases costs.

An alternative to welded vacuum processing chambers are vacuum processing chambers that were manufactured by casting, particularly vacuum processing chambers made from aluminum by means of sand casting. Manufacturing vacuum processing chambers by casting provides advantages, in particular if large scale vacuum processing chambers can be made by a single casting.

Briefly, the advantages are:

I. Many more opportunities in designing the chamber to be casted than a welded construction would allow. The opportunity to freely choose the number and positions of reinforcing rips permits to purposely use material where it is really needed at the chamber. For example, an area with high load may be provided with larger or stronger rips that a less loaded area. A slim production of the chamber enabled thereby reduces costs for material and transport.

II. Casting processes permit avoidance of advert dead spaces and gaps in a chamber to be manufactured.

III. Smooth transitions and/or transitions with any radius between individual walls of the chamber can be accomplished.

IV. The use of aluminum instead of stainless steel reduces the weight or the chamber. In addition, aluminum is known to be more resistant to those cleaning gases that are used today and will be used in future.

V. The freedom in designing the chamber permits reducing the chamber volume, because the walls of the chamber may be adapted to the components to processed within the chamber.

VI. A casting form made of wood or plastics for sand casting can be modified easily. This reduces the efforts to be made in case of subsequent chamber modifications.

A general problem in casting, in particular in sand casting, are the unavoidable pores in the surface of the casted part. Utilizing special cooling elements at the casting mould may substantially prevent pore forming at surfaces to be treated later, in particular at sealing surfaces. However, this method is too complicated and elaborate for extensive use. Thus, the untreated surfaces inside the casted chamber have to remain relatively rough. To improve the quality of these surfaces, they are smoothed by abrasion and crude polishing.

By said smoothening, the inner surface of the chamber is generally reduced. This is an important aspect, in particular for vacuum processing chambers, because the inner surface of the vacuum processing chamber constitutes an adsorption area whereat deposition vapours, oxygen, water, nitrogen and the like may be adsorbed.

On the other hand, said abrasion leads to the formation of microscopic cavities by the aluminum flow. Small recesses in the casted material may be plugged with particles that are produced during abrasion. The essential step of improving the inner surface of the vacuum processing chamber also causes fixation of abrasives, material obtained by the abrasion, residual cooling agent and the like in the cavities and recesses of the inner face of the vacuum processing chamber. However, these materials tend to gas-out during evacuation of the vacuum processing chamber—the desired pressure for processing is reached later.

Additionally, the compounds that gas-out may affect the subsequent vacuum processes. The usual and prescribed cleaning processes for a vacuum processing chamber do not or insufficiently reach those particles within the pores, cavities or recesses.

For these reasons, vacuum processing chambers made of aluminum by casting are rarely used nowadays.

SUMMARY OF INVENTION

It was therefore an object of the present invention to provide casted vacuum processing chambers made of aluminum by casting, wherein said vacuum processing chamber do not possess aforementioned disadvantages.

Accordingly, this object is achieved by a method wherein the inner face of a wall defining a volume of the vacuum processing chamber that can be evacuated is shot-blasted or pearl-blasted after grinding, and wherein said inner face of the wall is subsequently cleaned by washing.

The wall of the vacuum processing chamber is made from aluminum by casting, preferably by sand casting.

More specifically, the object is achieved by the independent claims. Advantageous embodiments are given in the dependent claims.

In particular, the present invention provides a method wherein the above-described cavities or pores are opened rather than being eliminated or sealed, and whereby particles contained in said cavities or pores are removed. The open cavities and pores in the inner surface of the vacuum processing chamber remain.

Said shot-blasting or pearl-blasting opens the micropores of the inner face of the wall of the vacuum processing chamber. In addition, said shot-blasting or pearl-blasting additionally compresses the material of the inner face. As a result, the properties of the inner face treated this way or the vacuum processing chamber comprising a wall with an inner face treated that way are at least as good as that of rolled-out aluminum with respect to gasing-out. In another embodiment, the walls are provided as partitions.

In a first aspect, the present invention provides a method for manufacturing vacuum processing chambers comprising a volume that can be evacuated, said volume being defined by a wall having an inner face and an outer face, wherein the inner face possesses improved properties with respect to its gas-out properties.

In a further aspect, the present invention provides vacuum processing chambers possessing improved gas-out properties.

In a further aspect, the present invention provides a method of improving the gas-out properties of an inner face of a wall defining a volume of a vacuum processing chamber which can be evacuated.

According to the first aspect, the invention provides a method for manufacturing a vacuum processing chamber comprising a volume which is defined by a wall and which can be evacuated, said wall being made of aluminum by casting, said wall comprising an outer face and an inner face, said inner face faces the volume, wherein the inner face of said wall is smoothened by grinding, and is subsequently pearl-blasted or shot-blasted.

The wall may comprise one aluminum cast or more aluminum casts.

According to a preferred embodiment, the wall of the vacuum processing chamber is made from aluminum by casting, preferably by sand casting.

In a preferred embodiment of the method for manufacturing vacuum processing chambers, the pearls or shots for use in the shot-blasting or pearl-blasting are made of a material that is selected from the group consisting of glass, ceramic, glass-ceramic, aluminum oxide and fibre compounds. Combinations of pearls or shots from the materials of said group may be employed for the shot-blasting or pearl-blasting of the aluminum cast.

Preferably, the diameter of the pearls or shots to be used for the shot-blasting or pearl-blasting of the wall is between 200 μm and 300 μm.

For the shot-blasting or pearl-blasting, a blasting system is used which comprises a jet nozzle. It is preferred that the jet nozzle of the blasting system has a calibre of between 5 mm to 8 mm. More preferably, the calibre of the jet nozzle is 6 mm.

For the shot-blasting or pearl-blasting of the inner face of the wall, a jet pressure of 3 to 6 bar is preferred. A jet pressure of about 5 bar is particularly preferred.

During shot-blasting or pearl-blasting, the distance between the jet nozzle and the surface of the inner face to be shot-blasted or pearl-blasted should be between 300 mm and 500 mm.

Said shot-blasting or pearl-blasting of the inner face of the wall may either be carried out manually or by means of a robotic device having an efficacy of approximately 6 $m^2$ per hour.

According to a further aspect, the present invention provides vacuum processing chambers which were manufactured according to the first aspect of the invention.

Thus, a vacuum processing chamber is provided, comprising a volume which is defined by a wall and which can be evacuated, said wall comprising an inner face which faces the volume, and an outer face, wherein the inner face of the wall has been smoothened by grinding, and shot-blasted or pearl-blasted thereafter.

In a preferred embodiment of the vacuum processing chamber, the inner face of the wall has been shot-blasted or pearl-blasted with the pearls or shots that were made of a material that is selected from the group consisting of glass, ceramic, glass-ceramic, aluminum oxide and fibre compounds.

Preferably, the inner face of the wall of the vacuum processing chamber has been shot-blasted or pearl-blasted with the pearls or shots having a diameter of 200 μm to 300 μm.

In another and/or further preferred embodiment, a blasting system was used for the pearl-blasting or shot-blasting of the inner face of the wall, said blasting system comprising a jet nozzle having a calibre of between 5 to 8 mm, preferably of about 6 mm.

In another and/or further preferred embodiment of the vacuum processing chamber, the jet pressure for the pearl-blasting or shot-blasting was between 3 to 6 bar, preferably about 5 bar.

In still another and/or further preferred embodiment, the distance between the jet nozzle and the surface of the inner face was between 300 mm and 500 mm during shot-blasting or pearl-blasting.

In a further aspect, the present invention provides a method for improving the inner face of a wall of vacuum processing chamber said vacuum processing chamber comprising a volume which is defined by the wall, said wall being made of aluminum by casting, said wall comprising an outer face and the inner face, said inner face facing the volume, wherein the inner face of said wall is smoothened by grinding and subsequent pearl-blasting or shot-blasting.

This aspect of the invention pertains to the opportunity to improve vacuum processing chambers that were manufactured from aluminum by casting. Pursuant to this aspect, it is possible to treat the inner surfaces of the walls defining the volume that can be evacuated of those vacuum processing chambers that are already in use, and to improve the properties of these vacuum processing chambers, in particular with respect to their gas-out properties, in that the inner faces of the walls of these vacuum processing chambers are shot-blasted or pearl-blasted as described in the first aspect of the invention.

BRIEF DESCRIPTION OF DRAWINGS

These and other aspects of the invention will be apparent from and elucidated with reference to the embodiments described hereinafter.

In the drawings.

DESCRIPTION OF EMBODIMENTS

Figure 1:
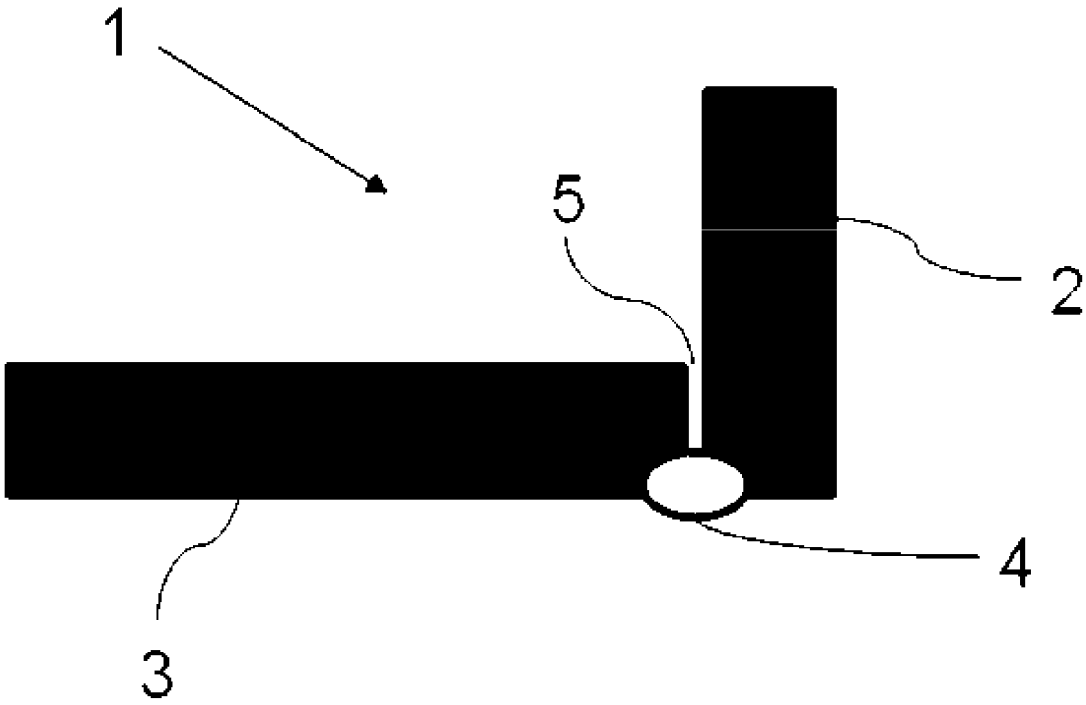
FIG. 1 shows a schematic representation of a corner joint of two plates being welded pursuant to prior art techniques.

In a corner joint 1 of a vacuum processing chamber according to known prior art as shown in FIG. 1 a first metal plate 2 is connected to a second metal plate 3 essentially at a right angle. The first metal plate 2 and the second metal plate 3 are connected to each other by welding on their outside only, wherein a welding seam 4 is restricted to the outer region of the first metal plate 2 and the second metal plate 3. On the inside of the corner joint 1, a gap 5 remains between the first metal plate 2 and the second metal plate 3.

Figure 2:
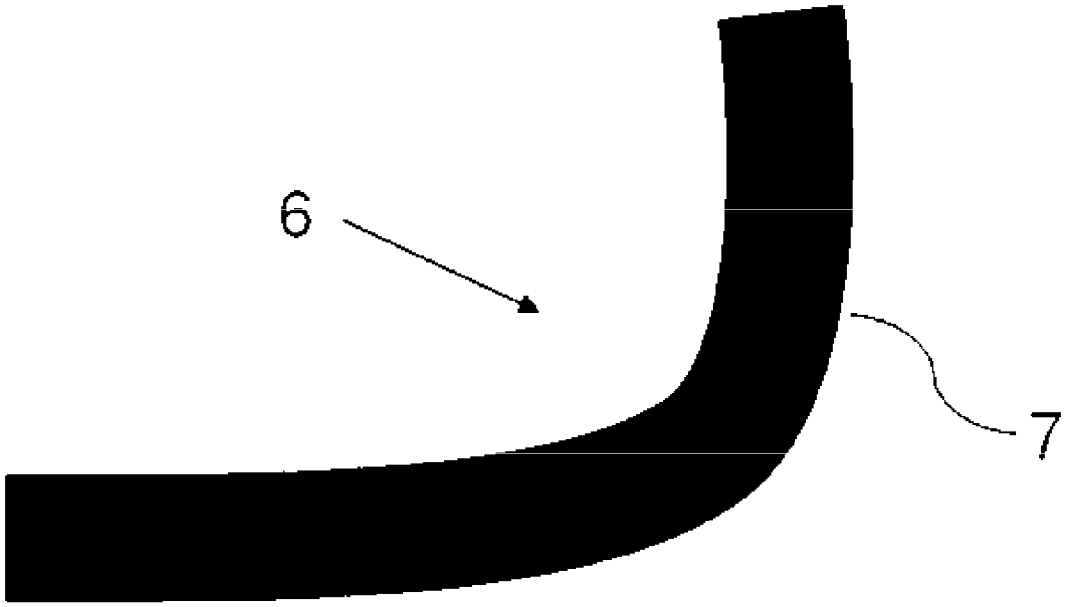
FIG. 2 shows a schematic representation of a corner of a castes element.

FIG. 2 represents the corner joint 6 of an aluminum cast 7. The corner joint 6 of the aluminum cast 7 shows a smooth and seamless transition from one plane to the other plane of said corner.

Figure 3:
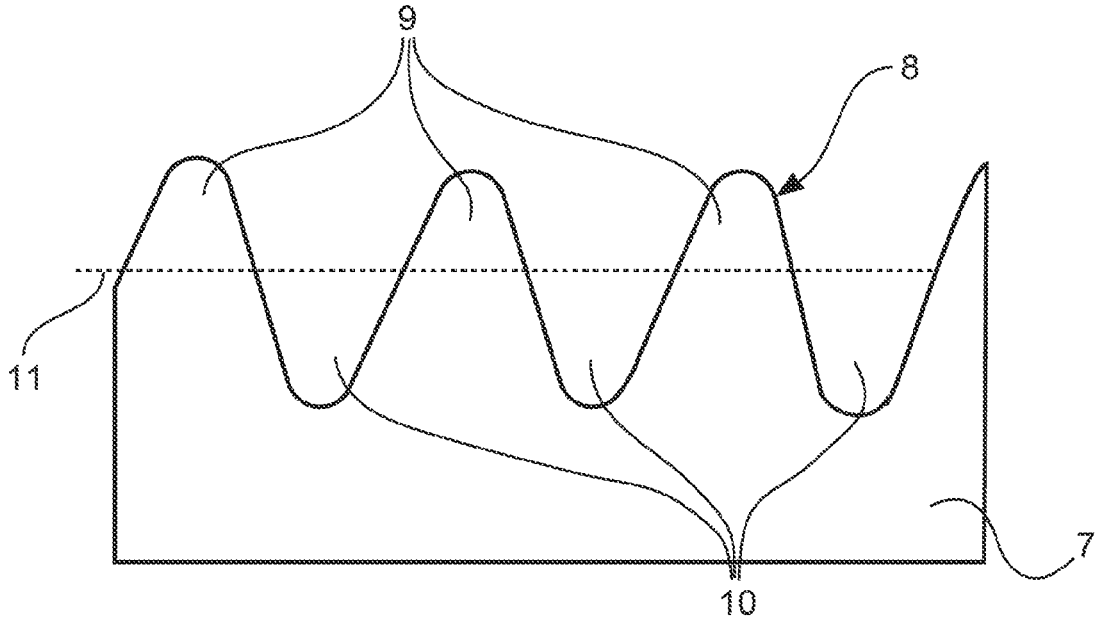
FIG. 3 shows a schematic representation of the rough inner face of an aluminum cast.

FIG. 3 shows an extremely simplified and schematic cross sectional view of an aluminum cast 7. The rough inner face 8 of the aluminum cast 7 possesses excessive peaks 9 and recesses 10. The dashed line 11 represents the desired plane after grinding.

Figure 4:
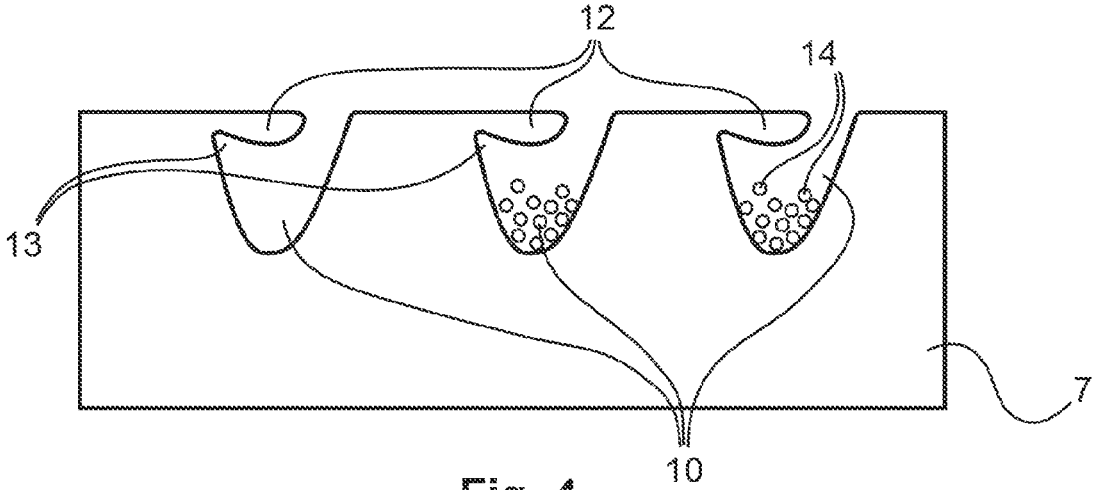
FIG. 4 shows a schematic representation of the inner face of an aluminum cast after grinding.

FIG. 4 shows an extremely simplified and schematic cross sectional view of the aluminum cast 7 shown in FIG. 3 after said aluminum cast 7 has been ground. The excessive peaks are removed down to the desired plane 11. However, the grinding caused protrusions 12 made of aluminum. Said protrusions 12 closed the recesses 10 partially or completely such that cavities 13 are formed. The cavities might contain or be filled with particles of dirt 14. Said particles 14 may be abrasion material or abraised material.

Figure 5:
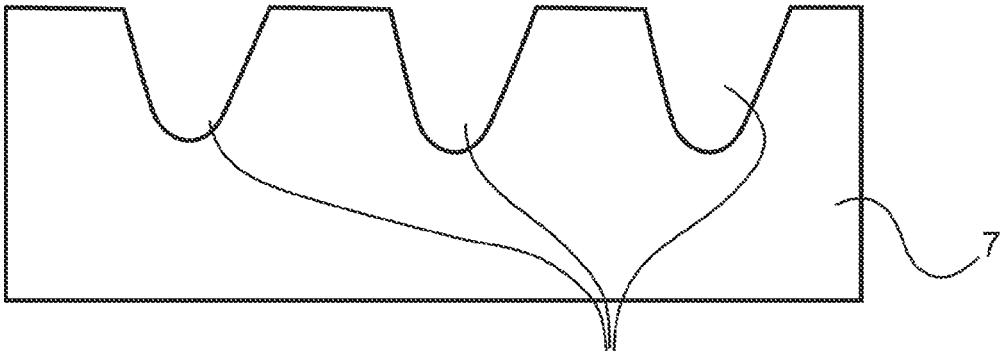
FIG. 5 a schematic representation of the inner face of an aluminum cast after grinding and subsequent shot-blasting.

FIG. 5 shows an extremely simplified and schematic cross sectional view of the aluminum cast 7 shown in FIG. 4 after said cast has been shot-blasted and washed. The recesses 10 that were at least partially closed after grinding are open again. The dirt 14 has been removed from the recesses. The smoothened and blasted surface of the aluminum cast 7 can be cleaned more easily and a vacuum processing chamber comprising such an inner face has improved properties with respect to gas-out and heat-out.

While the invention has been illustrated and described in detail in the drawings and foregoing description, such illustration and description are to be considered illustrative or exemplary and not restrictive; the invention is not limited to the disclosed embodiments. Other variations to be disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting scope.

REFERENCE SIGNS LIST

1 corner joint
2 first metal plate
3 second metal plate
4 welding seam
5 gap
6 corner joint
7 aluminum
8 inner face
9 peaks
10 recesses
11 dashed line
12 protrusion
13 cavity
14 particle

The invention claimed is:

1. A method for manufacturing a vacuum processing chamber comprising a volume which is defined by a wall and which can be evacuated, said wall being made of aluminum by casting, said wall comprising an outer face and an inner face, said inner face faces the volume, said method comprises smoothening the inner surface of said wall by grinding, and subsequent pearl-blasting or shot-blasting, wherein the pearls or shots for use in the pearl-blasting or shot-blasting have a diameter of 200 μm to 300 μm.

2. The method according to claim 1, wherein the pearls or shots for use in the pearl-blasting or shot-blasting are made of a material that is selected from the group consisting of glass, ceramic, glass-ceramic, aluminum oxide and fibre compounds.

3. The method according to claim 1, wherein a blasting system is used for the pearl-blasting or shot-blasting, said blasting system comprising a jet nozzle having a calibre of between 5 to 8 mm.

4. The method according to claim 1, wherein the jet pressure for the pearl-blasting or shot-blasting is between 3 to 6 bar.

5. The method according to claim 1, wherein the distance between the jet nozzle and the surface of the inner face to be shot-blasted or pearl-blasted should be between 300 mm and 500 mm during shot-blasting or pearl-blasting.

6. A method for improving an inner face of a wall of a vacuum processing chamber, said vacuum processing chamber comprising a volume which is defined by the wall, said wall being made of aluminum by casting, said wall comprising an outer face and the inner face, said inner face facing the volume, said method comprises smoothening the inner face of said wall by grinding, and subsequent pearl-blasting or shot-blasting, wherein the inner face of said wall is smoothened by the grinding and the subsequent pearl-blasting or shot-blasting, and wherein the pearls or shots for use in the pearl-blasting or shot-blasting have a diameter of 200 μm to 300 μm.

7. The method according to claim 6, wherein a blasting system is used for the pearl-blasting or shot-blasting, said blasting system comprising a jet nozzle having a calibre of between 5 to 8 mm.

8. The method according to claim 6, wherein the jet pressure for the pearl-blasting or shot-blasting is between 3 to 6 bar.

9. The method according to claim 6, wherein the distance between the jet nozzle and the surface of the aluminum cast to be shot-blasted or pearl-blasted being between 300 mm and 500 mm during shot-blasting or pearl-blasting.

* * * * *